US009169064B2

(12) United States Patent
Raymond et al.

(10) Patent No.: US 9,169,064 B2
(45) Date of Patent: Oct. 27, 2015

(54) BAG RELOADING GARBAGE UNIT

(71) Applicants: Loubert Joseph Raymond, Dunn, NC (US); Lukasz Opalinski, Miami, FL (US)

(72) Inventors: Loubert Joseph Raymond, Dunn, NC (US); Lukasz Opalinski, Miami, FL (US)

( * ) Notice: Subject to any disclaimer, the term of this patent is extended or adjusted under 35 U.S.C. 154(b) by 66 days.

(21) Appl. No.: 14/194,927

(22) Filed: Mar. 3, 2014

(65) Prior Publication Data

US 2015/0246772 A1 Sep. 3, 2015

(51) Int. Cl.

| | |
|---|---|
| ***B65D 25/14*** | (2006.01) |
| ***B65D 35/14*** | (2006.01) |
| ***B65F 1/14*** | (2006.01) |
| ***B65F 1/00*** | (2006.01) |
| ***B65F 1/06*** | (2006.01) |

(52) U.S. Cl.

CPC ..... *B65F 1/1415* (2013.01); *B65F 1/002* (2013.01); *B65F 1/0006* (2013.01); *B65F 1/062* (2013.01)

(58) Field of Classification Search

CPC ..... B65F 1/062; B65F 1/06; B65F 1/163; A47F 9/042; B65D 33/002; B65D 83/0811

USPC ..... 220/495.08, 495.07, 908, 908.1; 383/46, 906

See application file for complete search history.

(56) References Cited

U.S. PATENT DOCUMENTS

| | | | | |
|---|---|---|---|---|
| 3,392,825 | A | 7/1968 | Gale | |
| 3,451,453 | A * | 6/1969 | Heck | 206/390 |
| 3,481,112 | A | 12/1969 | Bourgeois | |
| 3,800,503 | A | 4/1974 | Maki | |
| 4,319,694 | A | 3/1982 | Nehrbass et al. | |
| 4,349,123 | A | 9/1982 | Yang | |
| 4,798,363 | A | 1/1989 | Cortesi | |
| 5,000,340 | A | 3/1991 | Leggio | |
| 5,294,017 | A | 3/1994 | Li | |
| 5,332,179 | A * | 7/1994 | Kuffel et al. | 248/74.3 |
| 5,458,259 | A | 10/1995 | Falk | |
| 5,881,900 | A | 3/1999 | Meshorer | |
| 6,193,095 | B1 | 2/2001 | McNeil | |
| 7,168,591 | B1 | 1/2007 | Miller | |
| 2003/0155783 | A1 * | 8/2003 | Hsu | 294/1.1 |
| 2005/0029281 | A1 | 2/2005 | Westermann | |
| 2012/0279181 | A1 * | 11/2012 | Gkinosatis | 53/443 |
| 2013/0155783 | A1 * | 6/2013 | Kottapalli et al. | 365/189.05 |

OTHER PUBLICATIONS

Uline Shipping Supply Specialists, Bag Buddy, available at http://www.uline.com/...duct/Detail/H-2628/Trash-Cans/Bag-Buddy?pricode=WU336&gadtype=pla&id=34610099002&gclid=CKe4hNnZqrgCFUyl4AodOnwA5g&gcisrc=aw.ds (retrieved Jul. 12, 2013).

Swift Bag, Swift Bag Demonstration, available at http://www.swiftbag.com/ (retrieved Jul. 7, 2013).

* cited by examiner

*Primary Examiner* — Mickey Yu
*Assistant Examiner* — Shawn M Braden
(74) *Attorney, Agent, or Firm* — Olive & Olive, P.A.

(57) ABSTRACT

A bag reloading garbage unit includes a base with a compartment therein for containing a plurality of separably interconnected garbage bags. The base includes a slot through which the garbage bags can be pulled into position for use. The base includes at least two articulable guide arms with guide channels therein for engaging with a garbage bag being pulled into position. When the garbage bag top arrives at the top of each articulable guide arm, the top of the garbage bag is secured in position within the unit. The guide arms operate to open and close the garbage bag. When the garbage bag is full, it is closed and removed by pulling upward and pulling with it a connected garbage bag into position in the garbage unit.

8 Claims, 5 Drawing Sheets

BAG RELOADING GARBAGE UNIT

FIELD OF THE INVENTION

This invention relates generally to garbage units with a reloading mechanism for supporting garbage bags. More particularly, the present invention relates to a garbage unit which, when pulling out a garbage bag that is full, automatically loads a new garbage bag in place for use.

BACKGROUND

Garbage bags are typically placed into garbage receptacles after emptying full garbage bags and replacing them with clean garbage bags by various persons, including cleaning crews. The problem with such devices is that a user must gather garbage bags from a supply closet or from a cart, and then manually replace the garbage bag into the garbage receptacle. More often than not, replacement garbage bags are not readily available, which causes inconvenience and a time consuming operation.

Presently, specialty garbage receptacles are available with various garbage bag dispensers built into and becoming an integral part thereof. However, such specialty garbage receptacles are often complex and difficult or cumbersome to use.

One prior art device includes a garbage bag dispenser for receiving a garbage bag continuously joined to, and separable from, other garbage bags. The device includes a housing for containing the garbage bag and a cover having a slot therein for guiding the garbage bag therethrough. The cover is moveably connected to the housing and integral therewith for allowing the cover to capture the garbage bag and to allow the garbage bag to freely move when urged through the slot. A closure made up of a snap button fastener and means for attaching the garbage bag dispenser to an interior of a garbage bag receptacle is made up of an adhesive backed hook and loop type fastener.

The system previously described relies on having a plurality of garbage bags continuously joined to and separable from another garbage bag for being received in a garbage receptacle, and for dispensing the garbage bag from the receptacle. While the feature of having a plurality of garbage bags separately attached to each other is used, the system described is complicated in structure and difficult to use.

In accordance with the invention, the problems of complex prior art systems are overcome by providing a simple structural device in which garbage bags separably secured to each other can be contained within a garbage unit with a garbage bag in place for receiving garbage. As the garbage bag becomes filled, it can be closed and removed from the garbage unit, and another garbage bag is automatically pulled into place and secured into position for use as a new garbage bag.

BRIEF SUMMARY

It is therefore an object of this invention to provide a bag reloading garbage unit which avoids the aforementioned problems of prior art devices.

In accordance with an exemplary embodiment, a bag reloading garbage unit includes a base having a storage compartment for storing a plurality of garbage bags therein. The base has a slot extending across a top surface thereof in one direction in communication with the storage compartment for allowing a garbage bag to be pulled out of the storage compartment through the open slot. A pair of guide members extend vertically at opposite sides of the base, each guide member having a guide channel and a securing end for allowing a garbage bag to be guided and secured in position with an opening of the garbage bag located at the top of the guide member. While not making up a part of the invention in its broadest aspect, garbage bags for use with the garbage unit may include a semirigid flexible material member at the top open end of each garbage bag for being secured into position within the guide members at the top thereof. The semirigid flexible member makes up an open rim of the garbage bag and is capable of flexing to allow access to the interior of the garbage bag at an opening at the top thereof.

The pair of guide members, which are located at a periphery of the base adjacent to said open slot, respectively, have sections which are articulable to cause the semirigid flexible member to open a garbage bag associated therewith when the guide members are articulated from a first position to a second position. An actuating mechanism is provided to cause the pair of guide members to articulate between the first and the second position, to allow access to the interior of the garbage bag and to close the garbage bag.

BRIEF DESCRIPTION OF THE DRAWINGS

Having briefly described embodiments of the invention, the same will become better understood from the detailed description which follows made with reference to the appended drawing, wherein.

DETAILED DESCRIPTION OF ILLUSTRATIVE EMBODIMENTS

Figure 1:
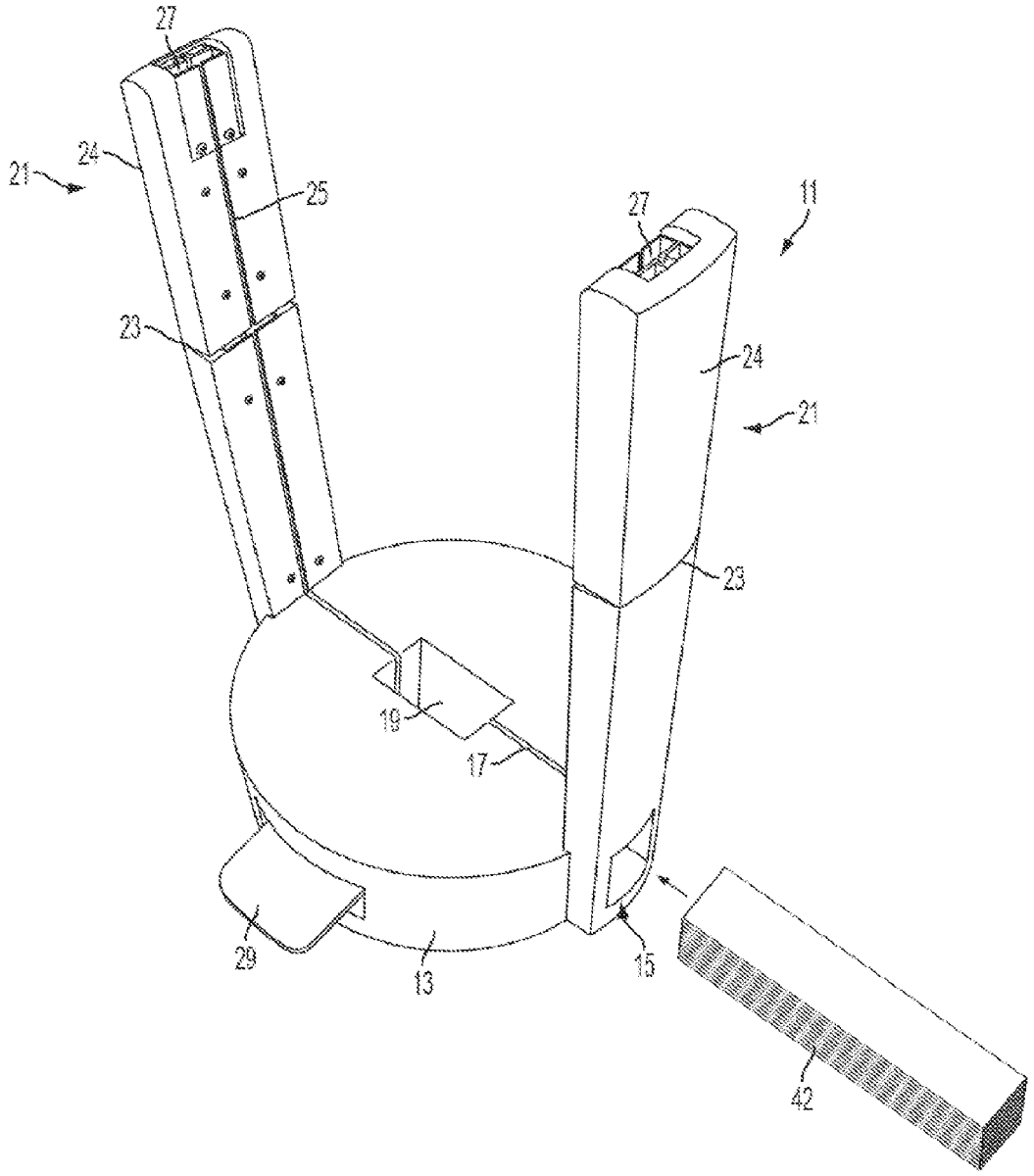
FIG. 1 is a perspective view of one embodiment of a bag reloading garbage unit shown without a garbage bag loaded therein.

FIG. 1 illustrates one embodiment of a bag reloading garbage unit 11 in accordance with one exemplary embodiment of the invention. The garbage unit 11 includes a base 13 having an opening 15 for loading a plurality of garbage bags into a storage compartment (not shown), which are connected to each other in a manner where they can be easily separated from each other. The base 13, which is optionally circular in shape, includes a slot 17 having a wider cutout section 19 at a center thereof for allowing reaching into the storage compartment, grabbing and pulling an individual garbage bag 41 (not shown in FIG. 1) upwardly through the slot 17. The garbage bags 41, 41' are connected together in a package or roll 42 making up a plurality of bags, which is inserted into the base 13 through the opening 15.

Figure 2:
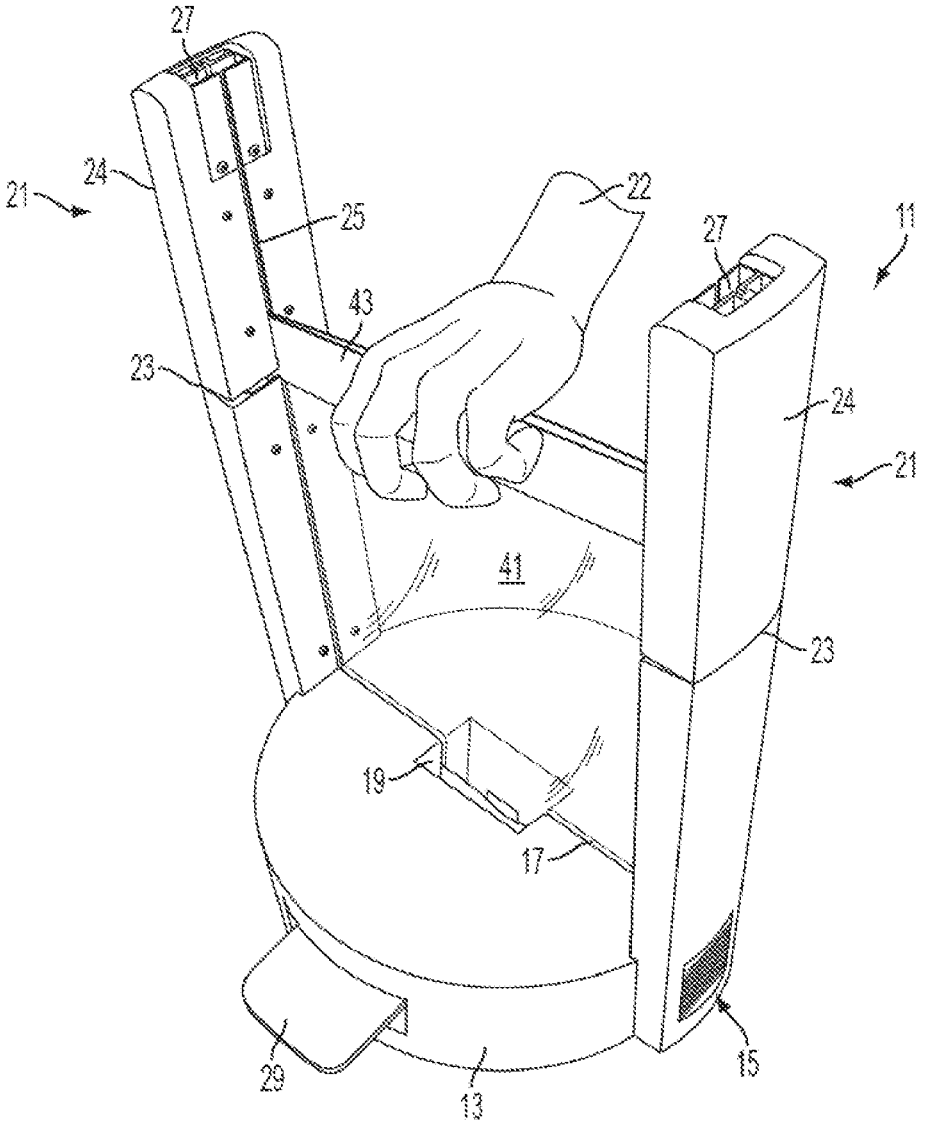
FIG. 2 is a perspective view of a bag reloading garbage unit in accordance with an embodiment of the invention shown with a garbage bag being loaded into the garbage unit.

The garbage bag 41, which is shown in FIG. 2 being pulled upwardly into a garbage unit 11 upper section, includes a semirigid member 43 making up a rim of the garbage bag 41 at an open end thereof. The semirigid member 43 is supported by articulable guide arms 21, in guide channels 25 thereof, to allow the garbage bag 41 to be pulled upwardly into upper portions 24 of the articulable guide arms 21 of the garbage unit 11 as shown in FIG. 2. The base 13 also includes an actuating pedal 29 connected through, for example, spring loaded cables (not shown) to the articulable guide arms 21, which articulate at the upper portion 24 at about a pivot connection 23 to open the garbage bag 41.

Figure 3:
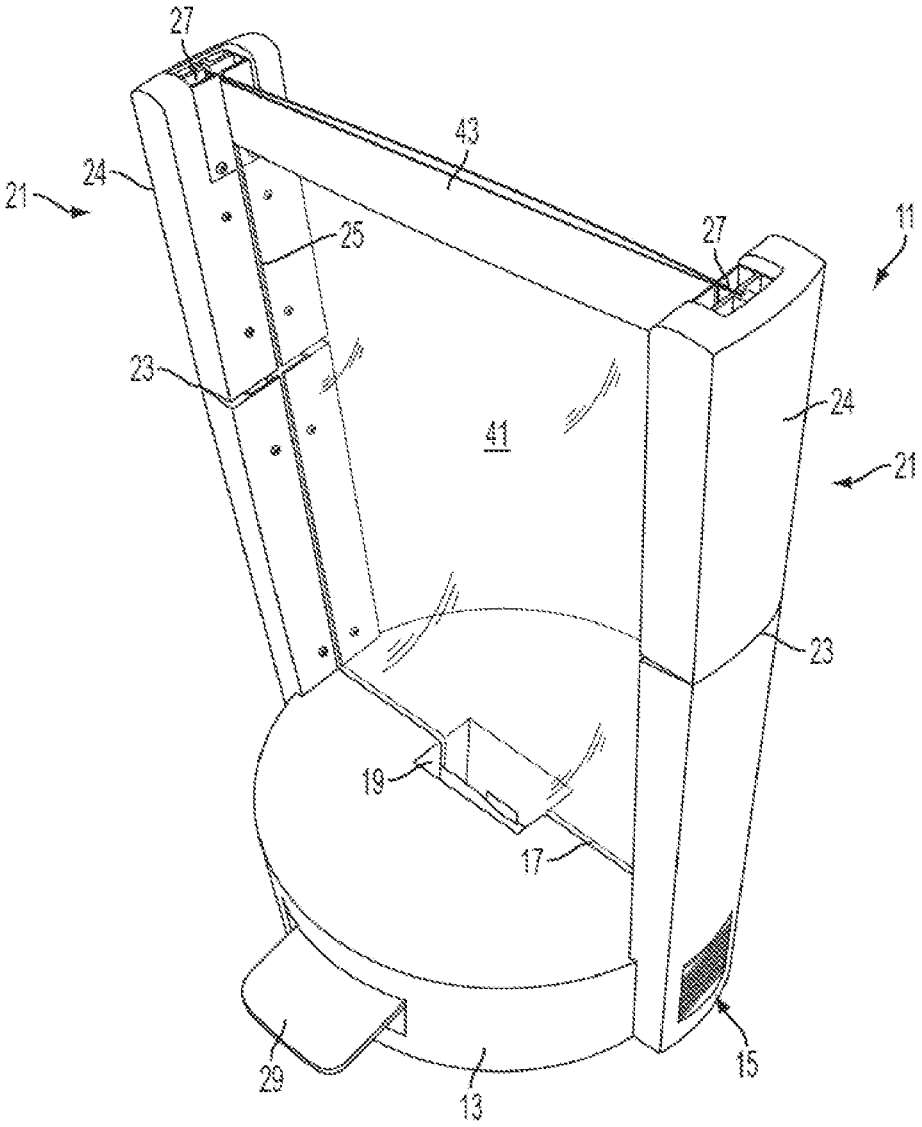
FIG. 3 is a perspective view of the bag reloading garbage unit in accordance with an embodiment of the invention shown with a garbage bag fully loaded into position therein.

As further shown in FIG. 2, a user may pull the garbage bag 41 upwardly through the slot 17 with a user's hand 22, so that the bag is guided upwardly within the guide channels 25 until the semirigid member 43 engages securing ends 27 of the guide channels 25 to be in position for use as shown in FIG. 3. The securing ends 27 employ conventional securing mechanisms which can take many different forms as will be apparent to those of ordinary skill. The securing ends 27 can take many forms such as a lock key, latch or spring loaded mechanism, etc., which can take these and other forms apparent to those of ordinary skill.

Figure 4:
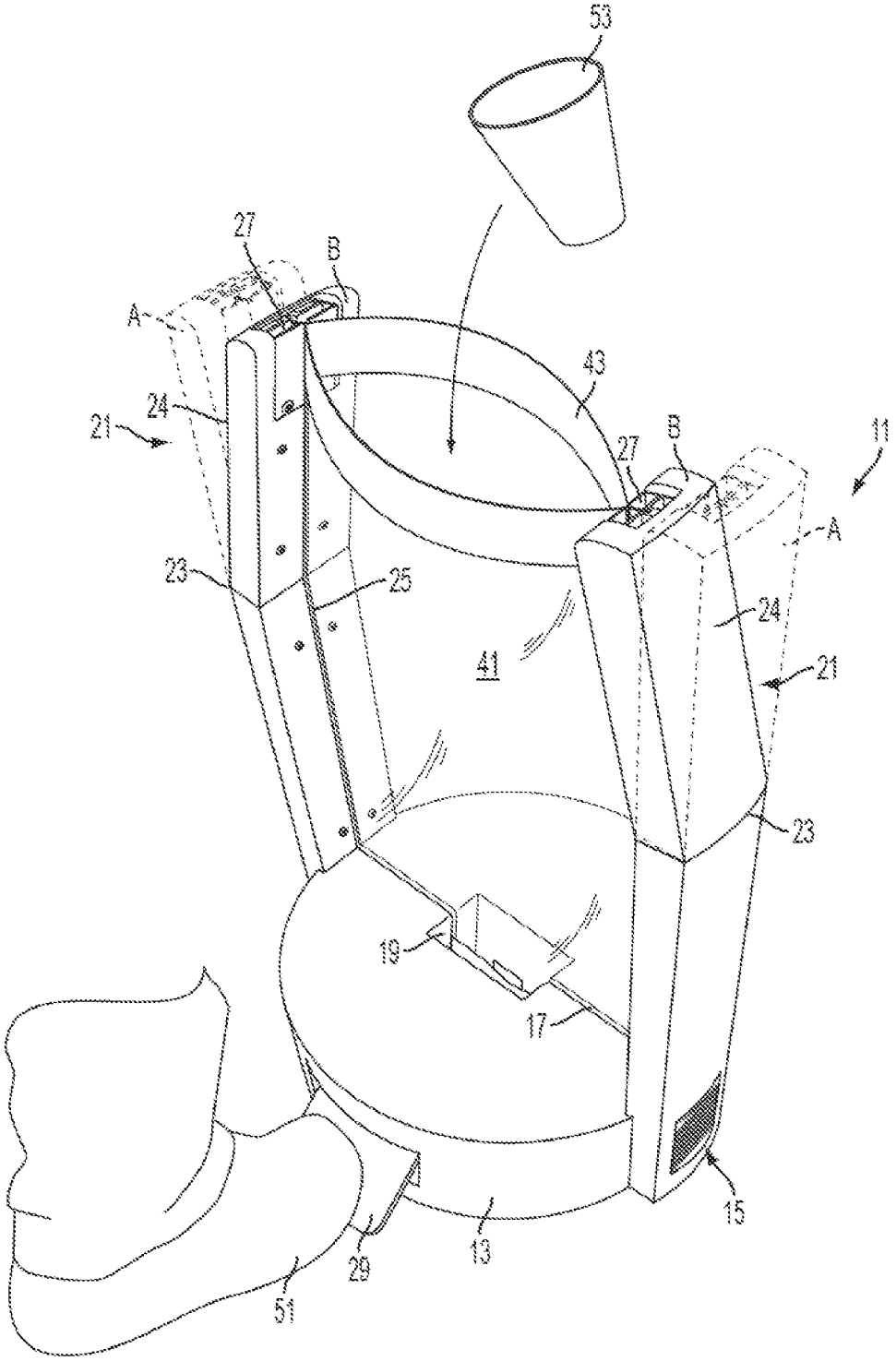
FIG. 4 is a perspective view of an embodiment of the bag reloading garbage unit of the invention shown with guide members flexing from a first position to a second position to force the garbage bag loaded therein to open.

As shown in FIG. 4, a user can open the garbage bag 41 by stepping on the actuating pedal 29 with a user's foot 51, which causes the spring loaded cables (not shown) which connect the actuating pedal 29 to the articulable guide arms 21 at the upper portions 24, to move the upper portions 24 of the articulable guide arms 21 to pivot inwardly from position A to position B, forcing the semirigid member 43 to flex, thereby opening the garbage bag 41 to allow placement of garbage items 53 into the garbage bag 41.

Figure 5:
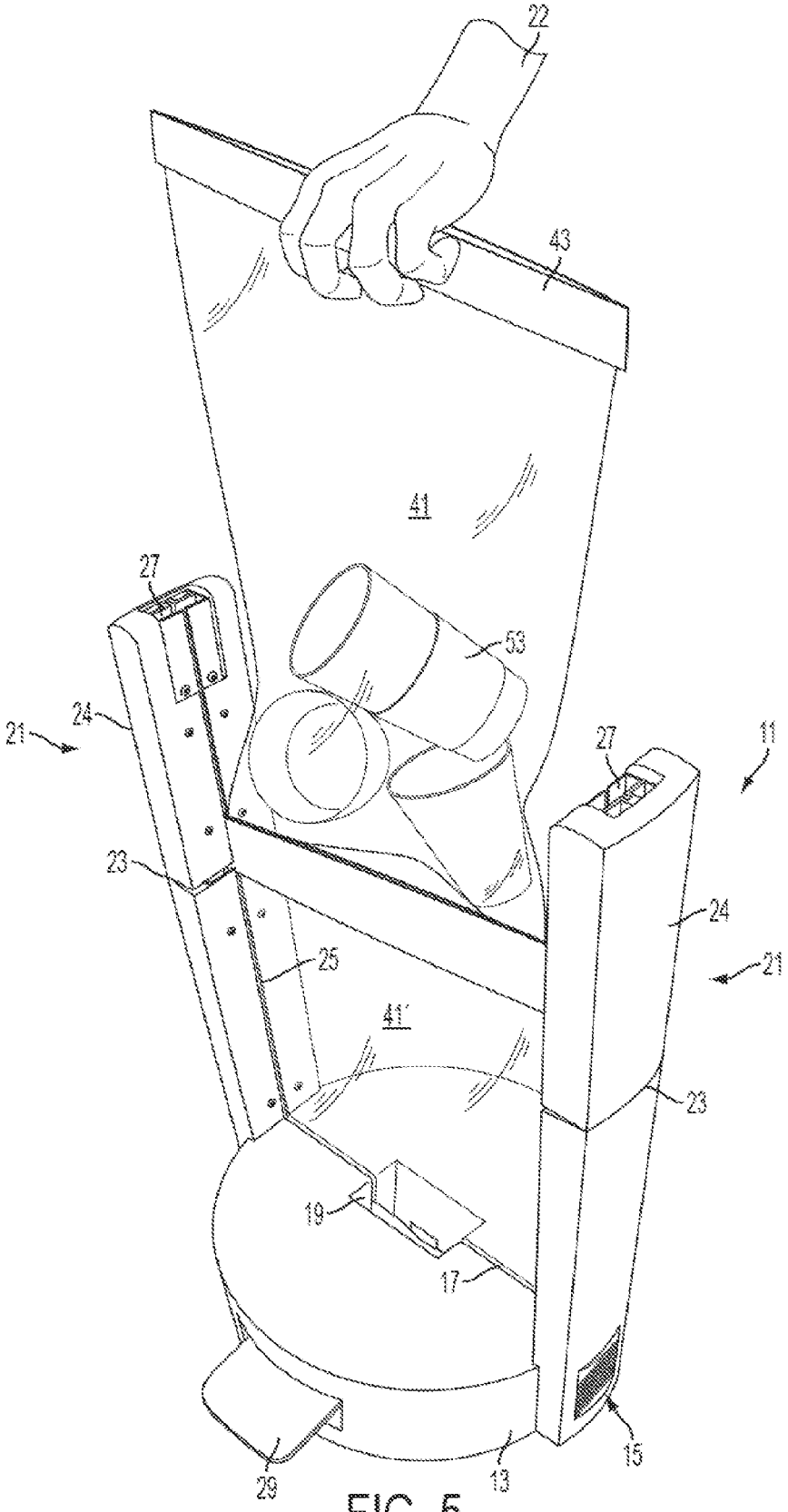
FIG. 5 is a perspective view of a full garbage bag being removed, with a replacement garbage bag being loaded into the garbage unit.

As further shown in FIG. 5, once the garbage bag 41 is filled with the garbage items 53, a user needs merely to grab the garbage bag 41, which is full, at the semirigid member 43 and seal the garbage bag 41 with a zip locking arrangement (not shown), which may be part of the semirigid member 43 (not shown), of conventional construction, and well known to the those of ordinary skill. The user then pulls the garbage bag 41 upwardly and out of the garbage unit 11, pulling a second garbage bag 41' upwardly into the garbage unit 11. Once the second garbage bag 41' has been pulled sufficiently upwardly enough to have the semirigid member 43 engage the securing ends 27, the first garbage bag 41 is then torn off from the second garbage bag 41', which is now received within the garbage unit 11, and the removed second garbage bag 41' is discarded.

With respect to materials used, it is preferable the garbage bag 41 be made using "green" technology. More specifically, the garbage bag 41 may be made biodegradable by using materials known to those of ordinary skill. The garbage unit 11 itself can also be made of different materials, such as metals, plastics, composites, etc., well known to those of ordinary skill.

One practical advantage of the invention is that it provides a convenient, practical, bag dispenser unit which allows a user to conveniently and in a sanitary manner handle garbage disposal. Of course, a wide variety of further uses and advantages of the present invention will become apparent to one skilled in the art.

Thus, the foregoing discussion outlines some of the more important features of the invention to enable a better understanding of the invention and to instill a better appreciation of the inventor's contribution to the art. It must be clear that the disclosed details of construction, descriptions of geometry and illustrations of invented concepts are mere examples of possible manifestations of the invention. Similarly, materials selected for construction of the invention may take many forms such as metals, plastics, composites, etc.

Although the invention has been shown and described with reference to certain illustrative embodiments, those skilled in the art will undoubtedly find alternative embodiments obvious after reading this disclosure. With this in mind, the following claims are intended to define the scope of protection to be afforded the inventor, and those claims shall be deemed to include equivalent construction insofar as they do not depart from the spirit and scope of the present invention.

What is claimed is:

1. A bag reloading garbage unit, comprising:

(a) a base having a storage compartment for storing a plurality of garbage bags therein, and said base having an open slot extending across one direction thereof in communication with said storage compartment, for allowing a garbage bag to be pulled out of the storage compartment through said open slot;

(b) a pair of guide members extending vertically at opposite sides of the base, each said guide member having a guide channel and a securing end for allowing the garbage bag to be guided and secured in position at a top of the pair of guide members at a semirigid flexible member, said semirigid flexible member being located at a top open end of each garbage bag making up an open rim of the garbage bag, and capable of flexing to allow access to an interior of the garbage bag;

(c) said pair of guide members being articulable to cause the semirigid flexible member secured thereto to open the garbage bag it is associated with when the pair of guide members are articulated from a first position to a second position; and (d) an actuating mechanism to cause said pair of guide members to articulate between the first position and the second position.

2. A bag reloading garbage unit as in claim 1, wherein said actuating mechanism comprises a pedal at the base connected to said pair of guide members through spring loaded cables.

3. A bag reloading garbage unit as in claim 1, wherein said open slot in said base includes a wider cutout section at a center thereof to allow grabbing the garbage bag with a user's hand.

4. A bag reloading garbage unit as in claim 1, wherein said base is circular in shape and said guide members are located at a location at a periphery of the base adjacent to said open slot, respectively.

5. A bag reloading garbage unit, comprising:

(a) a base having a storage compartment for storing a plurality of garbage bags therein, and said base having an open slot extending in one direction thereof in communication with said storage compartment, for allowing a garbage bag to be pulled out of the storage compartment through said open slot;

(b) the plurality of garbage bags separably connected to each other, and each garbage bag having a semirigid flexible member connected at an opening of each garbage bag to form a rim thereof for opening each garbage bag when flexed, and said plurality of garbage bags housed in said storage compartment;

(c) a pair of guide members extending vertically at opposite sides of the base, each said guide member having a guide channel and securing end for allowing the garbage bag to be guided and secured in position at a top of the pair of guide members at said semirigid flexible member;

(d) said pair of guide members being articulable to cause the semirigid flexible member secured thereto to open the garbage bag with which it is associated when the pair of guide members are articulated from a first position to a second position; and (e) an actuating mechanism to cause said pair of guide members to articulate between the first position and the second position.

6. A bag reloading garbage unit as in claim 5, wherein said actuating mechanism comprises a pedal at the base connected to said pair of guide members through spring loaded cables.

7. A bag reloading garbage unit as in claim 5, wherein said open slot in said base includes a wider cutout section at a center thereof to allow grabbing the garbage bag with a user's hand.

8. A bag reloading garbage unit as in claim 5, wherein said base is circular in shape and said guide members are located at a location at a periphery of the base adjacent to said open slot, respectively.

* * * * *